US005857617A

United States Patent [19]

Weng

[11] Patent Number: 5,857,617

[45] Date of Patent: Jan. 12, 1999

[54] VENTILATOR CONTROL DEVICE

[75] Inventor: Kuo-Liang Weng, Taichung Hsien, Taiwan

[73] Assignee: Yiue Feng Enterprise Co., Ltd., Taichung Hsien, Taiwan

[21] Appl. No.: 919,591

[22] Filed: Aug. 12, 1997

[51] Int. Cl.[6] ..... F24F 13/10

[52] U.S. Cl. ..... 236/49.3; 251/129.11; 251/305; 454/256; 454/333

[58] Field of Search ..... 236/49.3, 1 G; 251/129.11, 305, 367; 454/256, 322, 333

[56] References Cited

U.S. PATENT DOCUMENTS

| | | | |
|---|---|---|---|
| 4,193,541 | 3/1980 | Scheidweiler | 251/129.11 |
| 4,262,652 | 4/1981 | Butzen | 236/1 G |
| 4,527,771 | 7/1985 | Yeary | 251/305 |
| 4,559,867 | 12/1985 | Van Becelaere et al. | 251/305 |
| 4,653,725 | 3/1987 | Nanz et al. | 251/367 |
| 5,259,411 | 11/1993 | Guzorek | 454/333 |
| 5,370,360 | 12/1994 | Buckley | 251/305 |
| 5,695,116 | 12/1997 | Karabin | 236/1 G |

*Primary Examiner*—William E. Tapolcai
*Attorney, Agent, or Firm*—Peterson, Wicks, Nemer & Kamrath, P.A.

[57] ABSTRACT

A ventilator control device has a hollow lower seat, a hollow upper seat disposed on the hollow lower seat, and a block disk disposed between the hollow lower seat and the hollow upper seat. The hollow lower seat has a top flange and a top notch. A lower cushion surrounds the hollow lower seat and is blocked by the top flange. The upper seat has a bottom flange, a bottom notch, and a protrusion. An upper cushion surrounds the hollow upper seat and is blocked by the bottom flange. The block disk has an axle and an opposite block seat. The axle and the opposite block seat are arranged along an axis. A motor seat is inserted in the top notch. The motor seat receives a motor. The motor has a block inserted in the block seat. A controller is disposed on the hollow lower seat to control a rotation of the motor and a vibration of the block disk.

4 Claims, 9 Drawing Sheets

VENTILATOR CONTROL DEVICE

BACKGROUND OF THE INVENTION

The present invention relates to a ventilator control device. More particularly, the present invention relates to a ventilator control device which can control a ventilator and an amount of wind.

A conventional ventilator control device often needs a large number of parts and many assembled elements. Furthermore, a conventional ventilator control device is easily broken.

SUMMARY OF THE INVENTION

An object of the present invention is to provide a ventilator control device which can control a block disk to vibrate according to an instruction of a central processing unit in order to allow a varied amount of wind to pass a ventilator.

Accordingly, a ventilator control device comprises a hollow lower seat, a hollow upper seat disposed on the hollow lower seat, and a block disk disposed between the hollow lower seat and the hollow upper seat. The hollow lower seat has a top flange and a top notch. A lower cushion surrounds the hollow lower seat and is blocked by the top flange. The upper seat has a bottom flange, a bottom notch, and a protrusion. An upper cushion surrounds the hollow upper seat and is blocked by the bottom flange. The block disk has an axle and an opposite block seat. The axle and the opposite block seat are arranged along an axis. A motor seat is inserted in the top notch. The motor seat receives a motor. The motor has a block inserted in the block seat. A controller is disposed on the hollow lower seat to control a rotation of the motor and a vibration of the block disk. The controller has a heat/cool requirement unit, a comfortable rate adjustment unit, a stop requirement unit, at least a set element, at least a temperature sensor, at least a relative humidity sensor, a central processing unit, a swap analysis unit, a display unit, a steering control unit, a rotating speed control unit, and a time control unit.

DETAILED DESCRIPTION OF THE INVENTION

Figure 1:
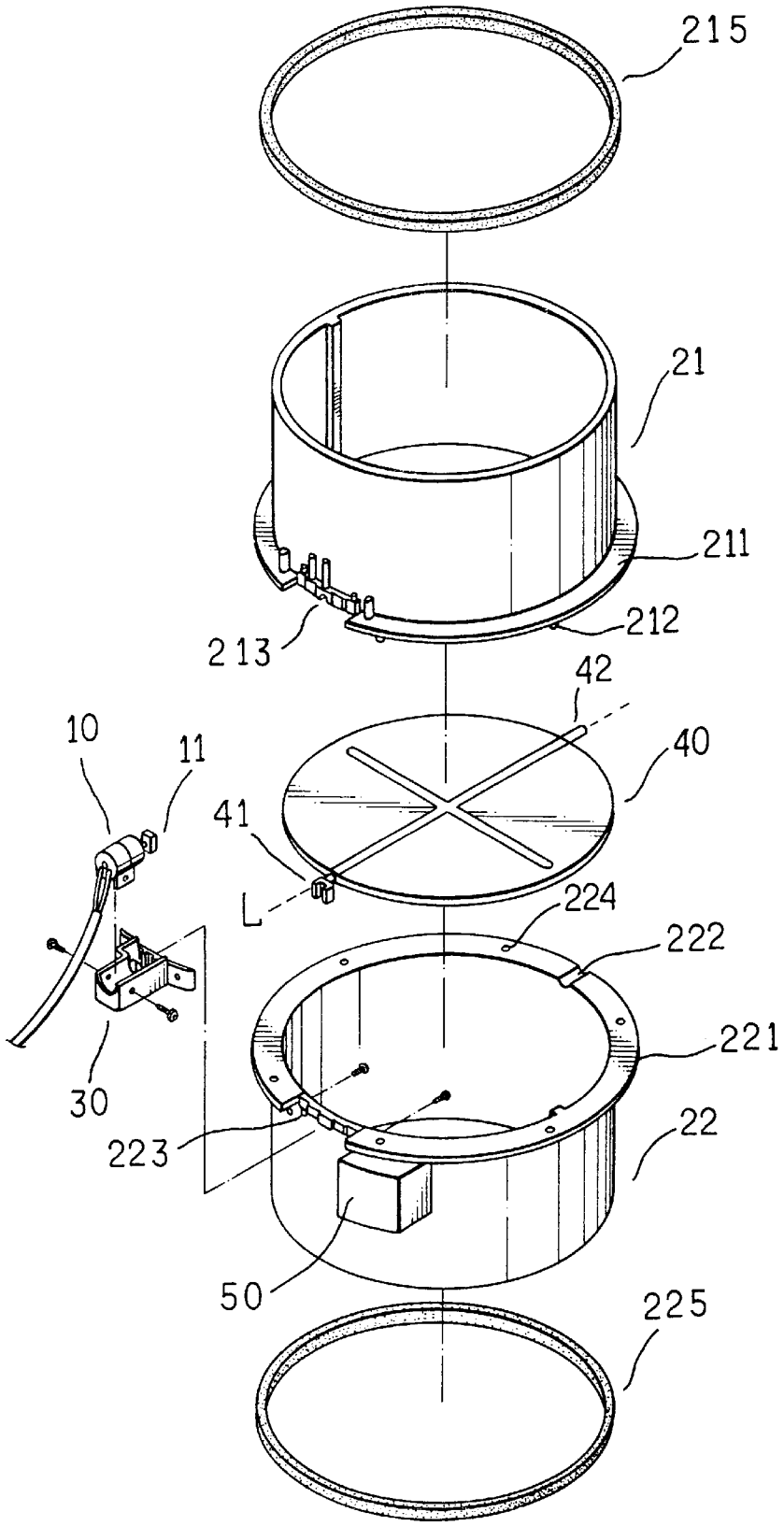
FIG. 1 is a perspective exploded view of a ventilator control device of a first preferred embodiment in accordance with the present invention.
Figure 5:
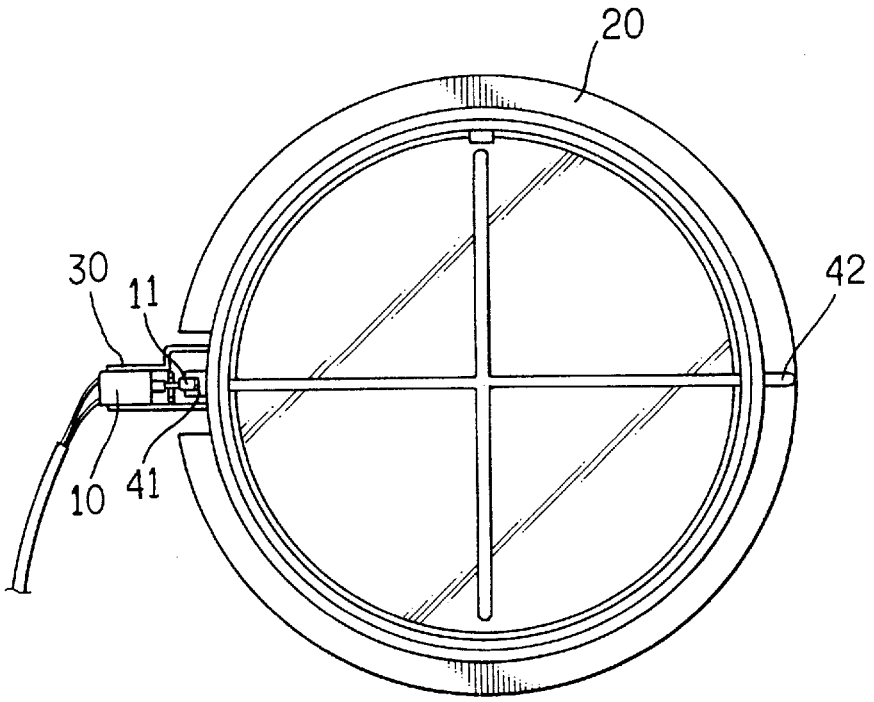
FIG. 5 is a schematic view illustrating a vibration of a block disk.
Figure 6:
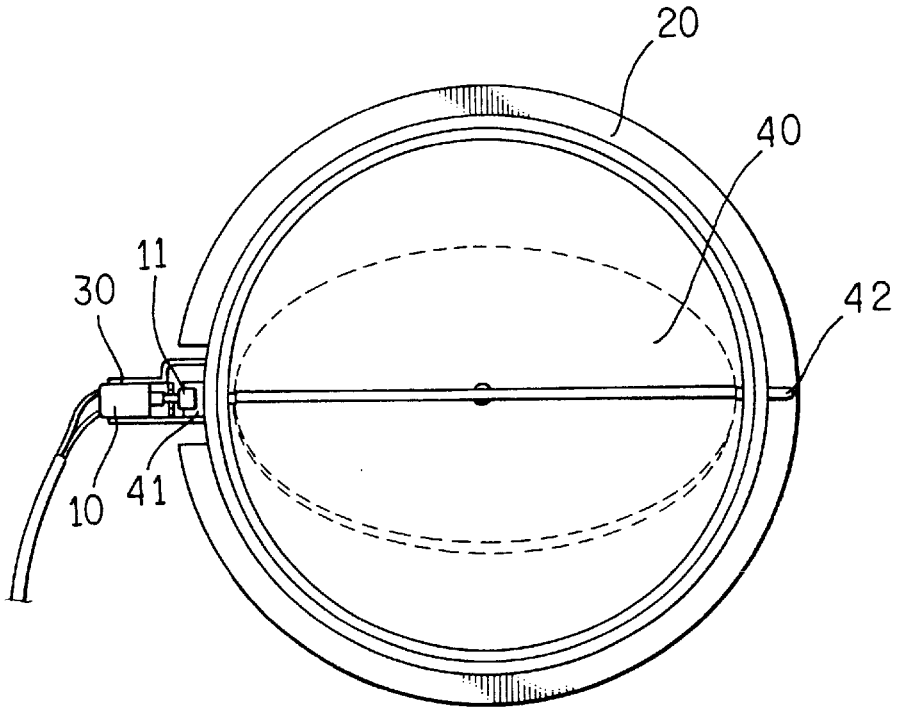
FIG. 6 is another schematic view illustrating a vibration of a block disk.

Referring to FIGS. 1, 5 and 6, a ventilator control device comprises a hollow lower seat 22, a hollow upper seat 21 disposed on the hollow lower seat 22, and a block disk 40 disposed between the hollow lower seat 22 and the hollow upper seat 21. The hollow lower seat 22 has a top flange 221, a recess 222 formed on the top flange 221, an insertion hole 224 formed on the top flange 221, and a top notch 223. A lower cushion 225 surrounds the hollow lower seat 22 and is blocked by the top flange 221. The upper seat 21 has a bottom flange 211, a bottom notch 213, and a protrusion 212. An upper cushion 215 surrounds the hollow upper seat 21 and is blocked by the bottom flange 211. The block disk 40 has an axle 42 and an opposite block seat 41. The axle 42 and the opposite block seat 41 are arranged along an axis L. A motor seat 30 is inserted in the top notch 223. The motor seat 30 receives a motor 10. The motor 10 has a block 11 inserted in the block seat 41. A controller 50 is disposed on the hollow lower seat 22 to control a rotation of the motor 10 and a vibration of the block disk 40. The recess 222 receives the axle 42. The insertion hole 224 receives the protrusion 212.

Figure 2:
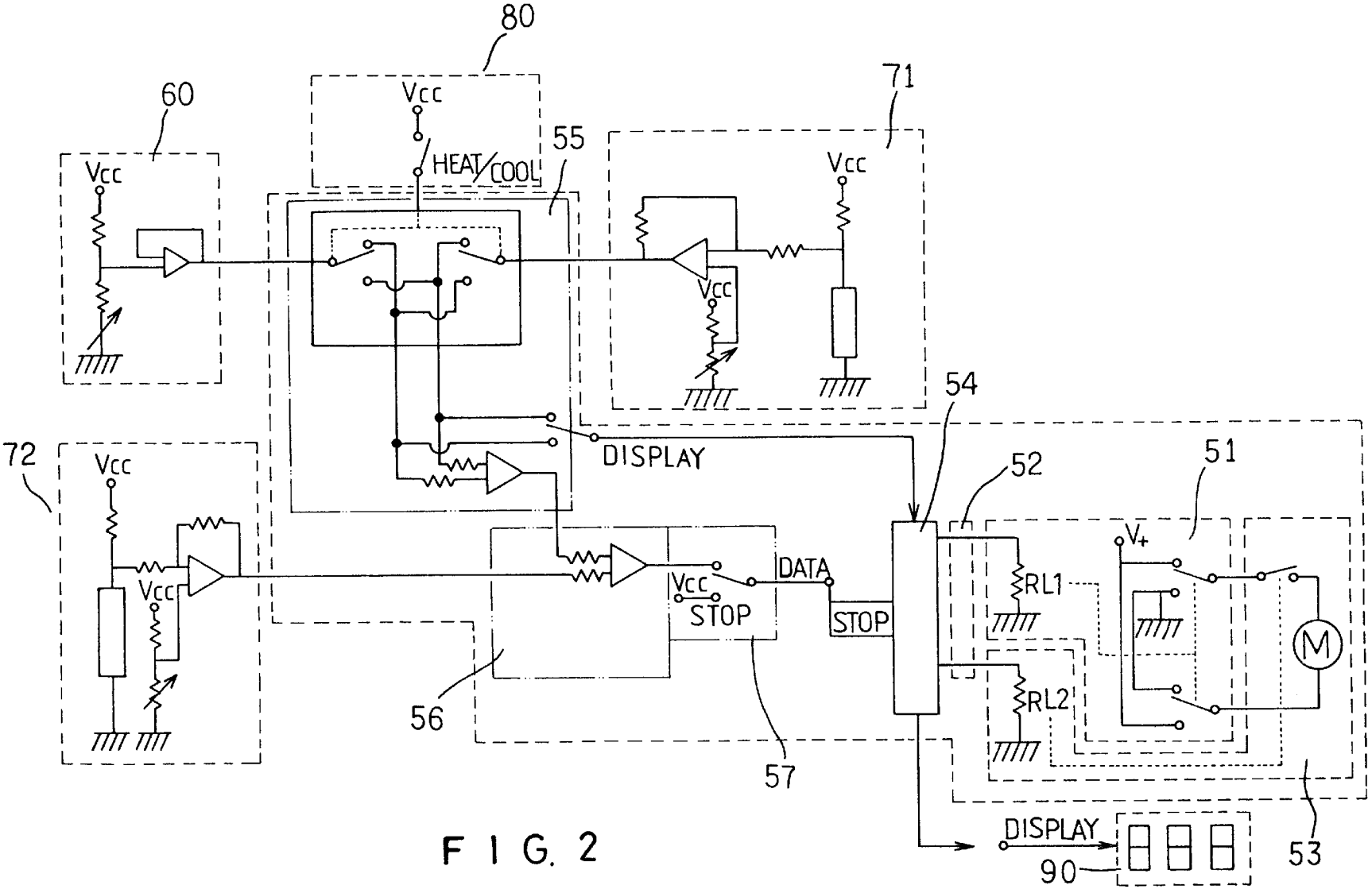
FIG. 2 is a circuit diagram of a first preferred embodiment in accordance with the present invention.
Figure 3:
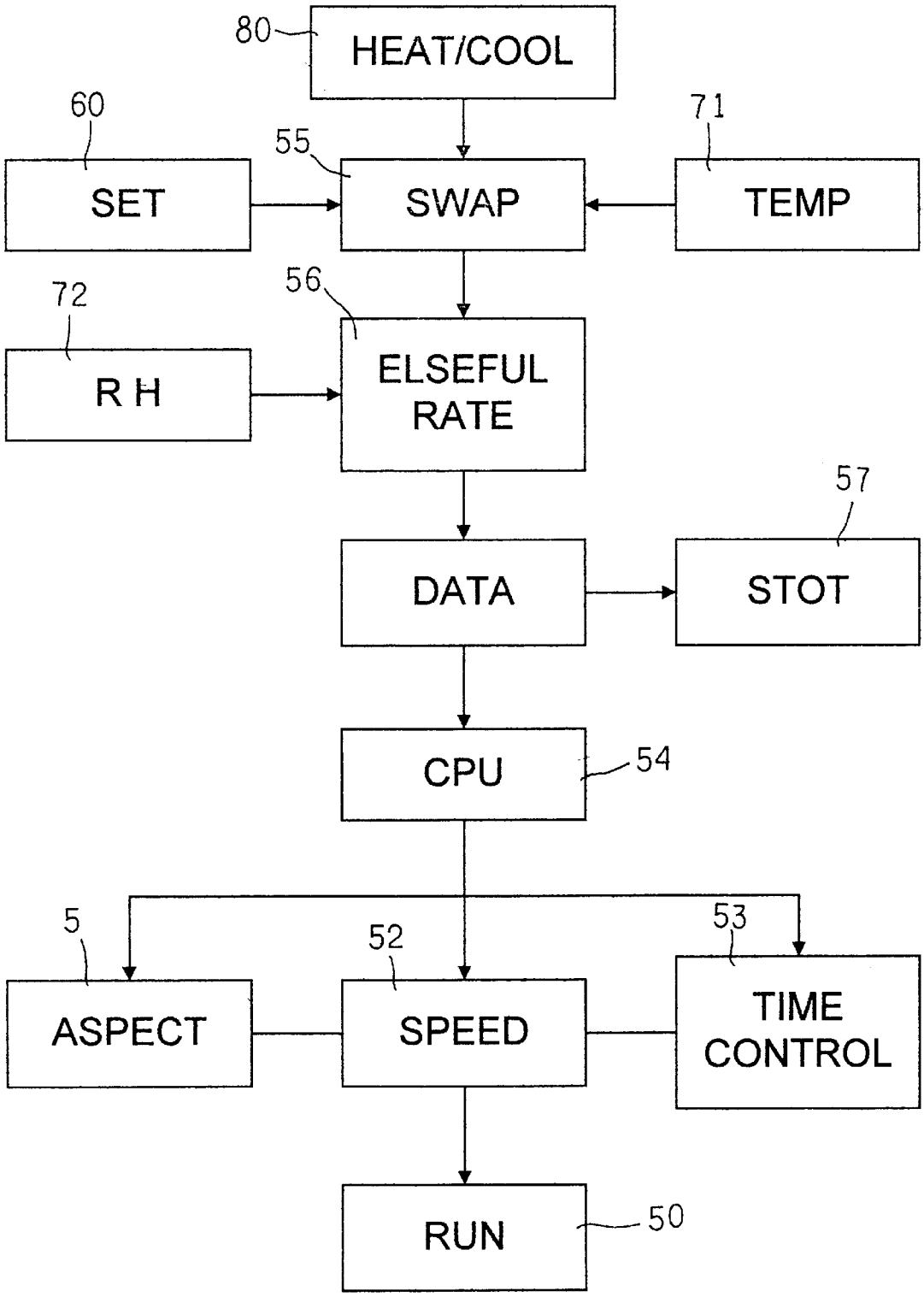
FIG. 3 is a block diagram illustrating a function of a ventilator control device of a first preferred embodiment in accordance with the present invention.

Referring to FIGS. 2 and 3, the controller 50 has a heat/cool requirement unit (HEAT/COOL) 80, a comfortable rate adjustment unit (ELSEFUL RATE) 56, a stop requirement unit (STOP) 57, at least a set element (SET) 60, at least a temperature sensor (TEMP) 71, at least a relative humidity sensor (RH) 72, a central processing unit (CPU) 54, a swap analysis unit (SWAP) 55, a display unit 90, a steering control unit (ASPECT) 51, a rotating speed control unit (SPEED) 52, and a time control unit (TIME) 53.

Referring to FIG. 3 again, the heat/cool requirement unit (HEAT/COOL) 80 sends a heat,cool requirement signal to the swap analysis unit (SWAP) 55. The set element (SET) 60 sends a temperature/humidity setting requirement signal to the swap analysis unit (SWAP) 55. The temperature sensor (TEMP) 71 sends a temperature sensing signal to the swap analysis unit (SWAP) 55. The swap analysis unit (SWAP) 55 sends a signal to the comfortable rate adjustment unit (ELSEFUL RATE) 56. The relative humidity sensor (RH) 72 sends a humidity sensing signal to the comfortable rate adjustment unit (ELSEFUL RATE) 56. The comfortable rate adjustment unit (ELSEFUL RATE) 56 outputs a data to a data collection and transmission unit (DATA) 58. When the data shows that the temperature and the humidity need not be changed, the stop requirement unit (STOP) 57 will operate. When the data shows that the temperature and the humility should be changed, the central processing unit (CPU) 54 will operate. The central processing unit (CPU) 54 controls the steering control unit (ASPECT) 51, the rotating speed control unit (SPEED) 52, and the time control unit (TIME) 53 to operate. The rotating speed control unit (SPEED) 52 outputs a run instruction (RUN) 50 to the motor 10. When the motor 10 runs, the block disk 40 will vibrate according to an instruction of the central processing unit (CPU) 54 in order to allow a varied amount of wind to pass a ventilator.

Figure 4:
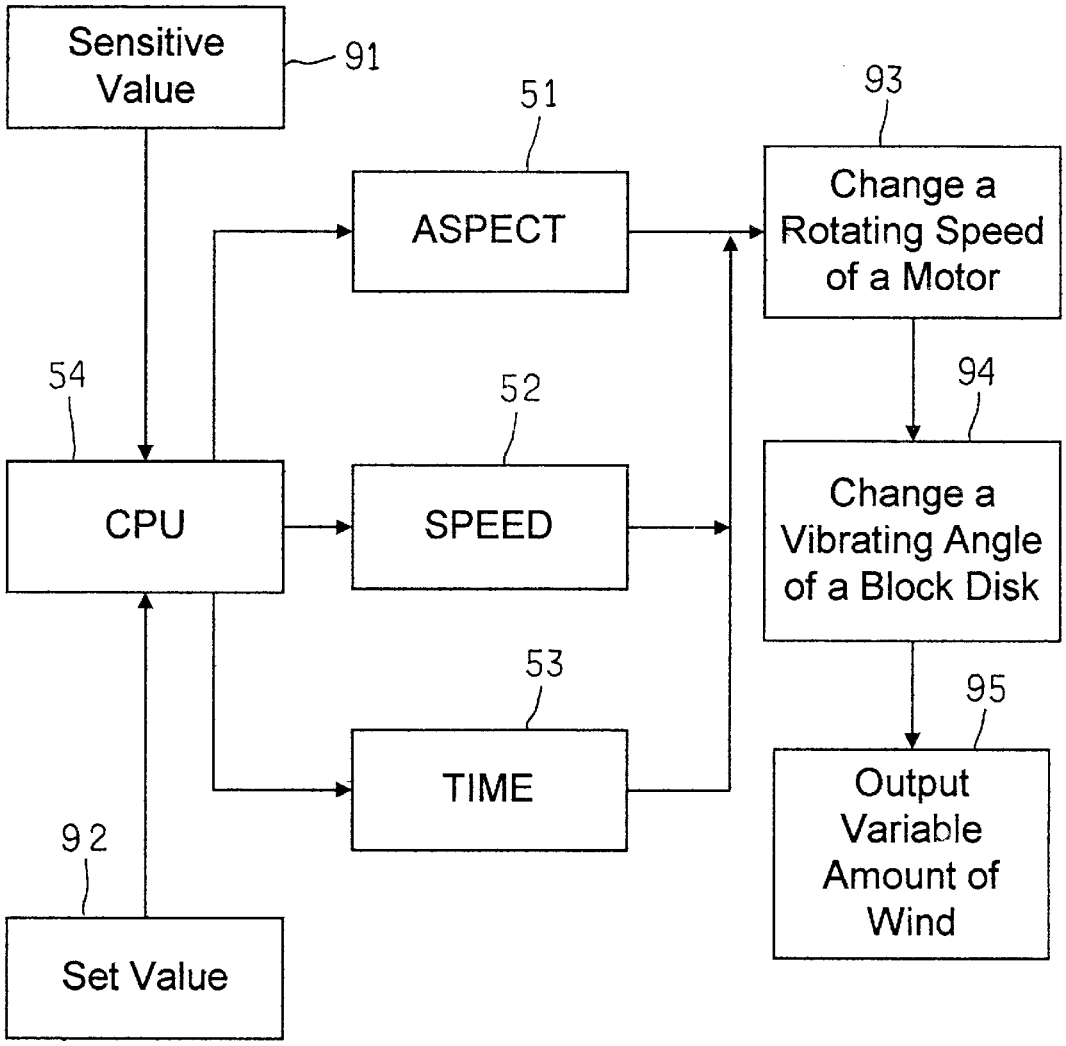
FIG. 4 is a flow diagram of a ventilator control device of a first preferred embodiment in accordance with the present invention.

Referring to FIG. 4, a sensitive value 91 and a set value 92 are compared with in the central processing unit (CPU) 54. The central processing unit (CPU) 54 controls the steering control unit (ASPECT) 51, the rotating speed control unit (SPEED) 52, and the time control unit (TIME) 53 to operate. The operation of the run instruction (RUN) 50 includes a first step 93 for changing a rotating speed of the motor 10, a second step 94 for changing a vibrating angle of the block disk 40, and a third step 95 for outputting variable amount of wind.

Figure 7:
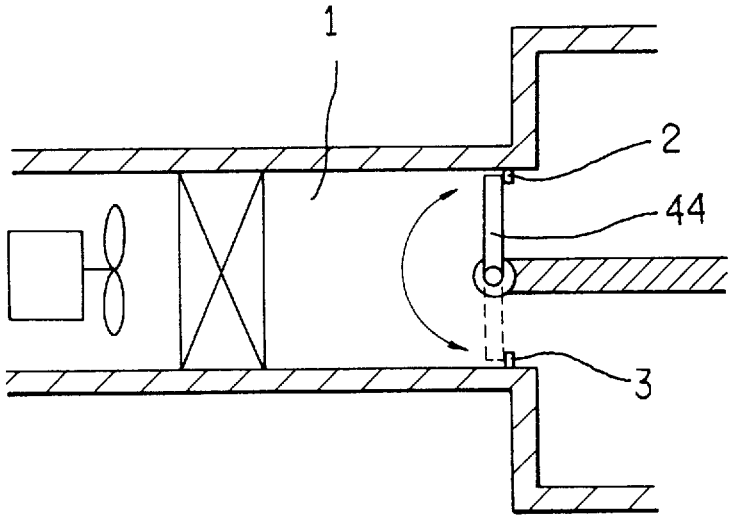
FIG. 7 is a schematic view illustrating an application of another block disk.
Figure 8:
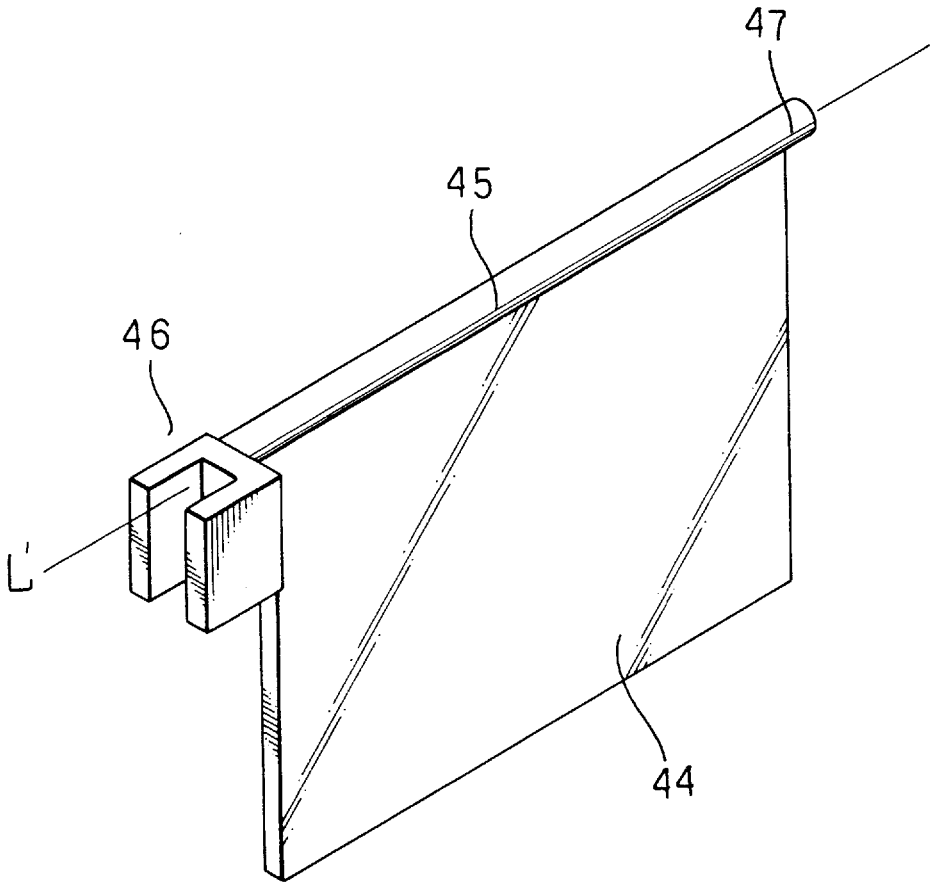
FIG. 8 is a perspective of another block disk.

Referring to FIGS. 7 and 8, a block plate 44 has a pivot rod 45 and a block seat 46. An axis L' is formed along a periphery 47 of the pivot rod 45. The block plate 44 is disposed on an opening of a wind chamber 1. A first block post 2 is disposed in the wind chamber 1 to block the block plate 44. A second block post 3 is disposed in the wind chamber 1 to block the block plate 44.

Figure 9:
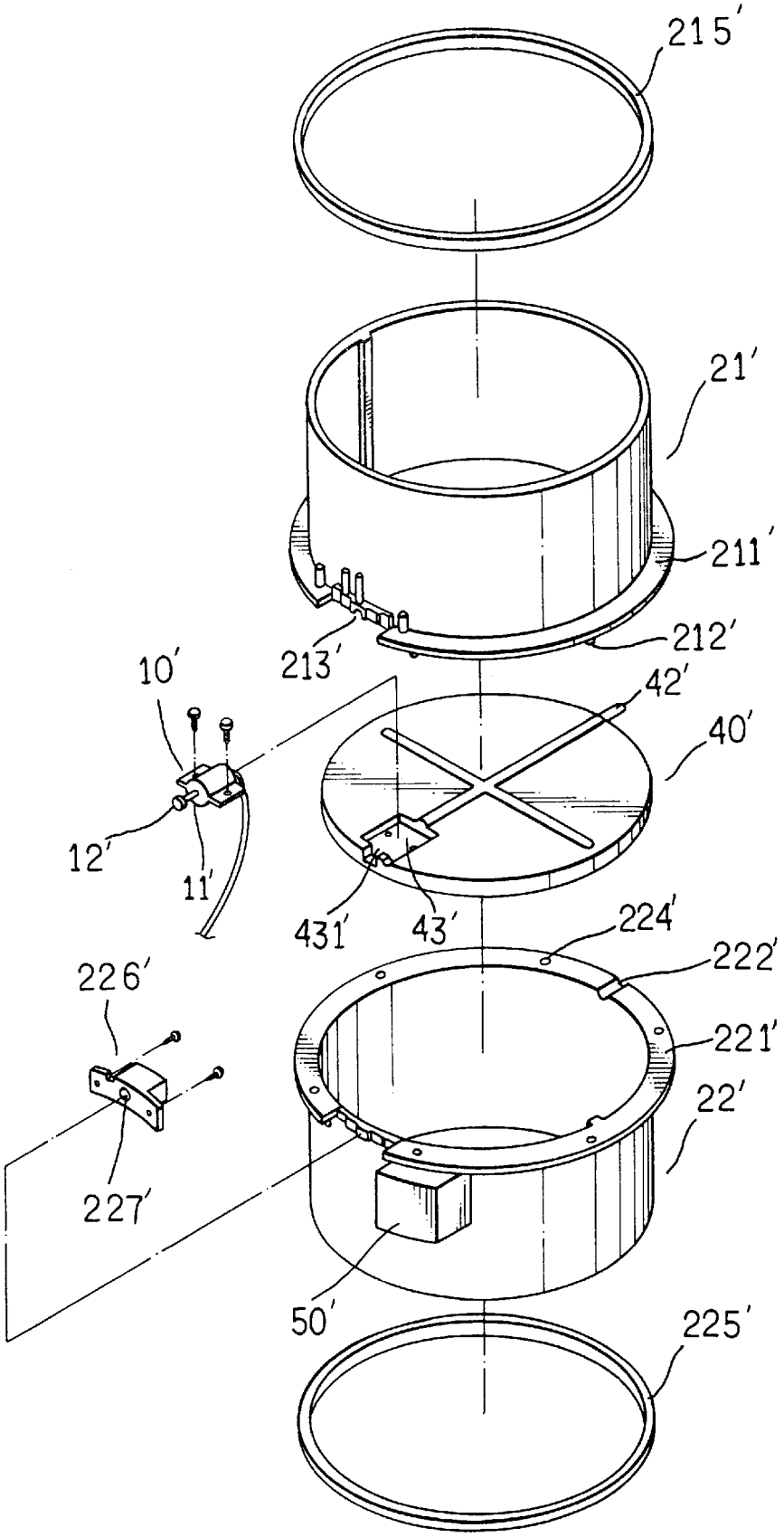
FIG. 9 is a perspective exploded view of a ventilator control device of a second preferred embodiment in accordance with the present invention.
Figure 10:
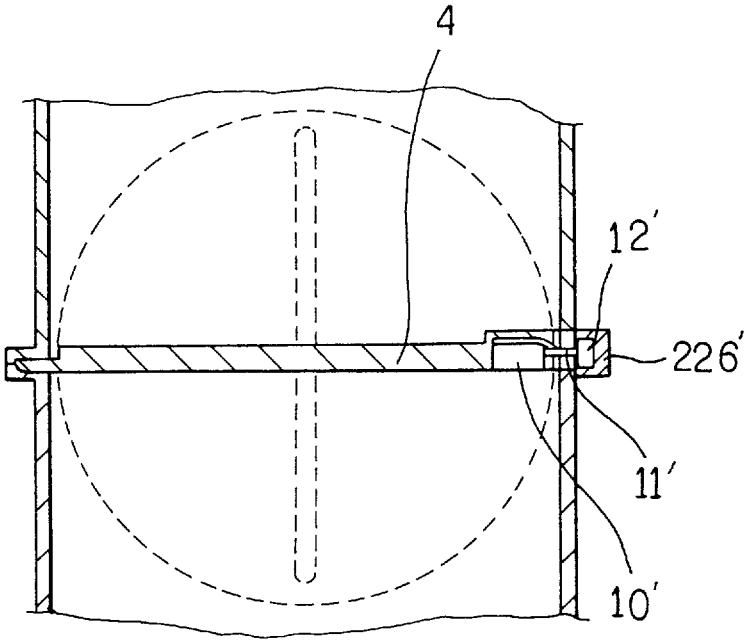
FIG. 10 is a schematic view illustrating an operation of a second preferred embodiment in accordance with the present invention.

Referring to FIGS. 9 and 10, another ventilator control device comprises a hollow lower seat 22', a hollow upper seat 21' disposed on the hollow lower seat 22', and a block disk 40' disposed between the hollow lower seat 22' and the hollow upper seat 21'. The hollow lower seat 22' has a top flange 221', a recess 222' formed on the top flange 221', an insertion hole 224' formed on the top flange 221', and a top notch 223'. A lower cushion 225' surrounds the hollow lower seat 22' and is blocked by the top flange 221'. The upper seat 21' has a bottom flange 211', a bottom notch 213', and a protrusion 212'. An upper cushion 215' surrounds the hollow upper seat 21' and is blocked by the bottom flange 211'. The block disk 40' has an axle 42' and an opposite slot 43'. A groove 431' is formed on a periphery of the block disk 40' communicating with the slot 43'. A positioning seat 226' is inserted in the top notch 223'. The positioning seat 226' has a through hole 227'. A motor 10' has a shaft 11' and a block 12' disposed on a distal end of the shaft 11'. The motor 10' is inserted in the slot 43'. The block 12' is inserted in the through hole 227'. A controller 50' is disposed on the hollow lower seat 22' to control a rotation of the motor 10' and a vibration of the block disk 40'. The recess 222' receives the axle 42'. The insertion hole 224' receives the protrusion 212'.

The invention is not limited to the above embodiment but various modification thereof may be made. Further, various changes in form and detail may be made without departing from the scope of the invention.

I claim:

1. A ventilator control device comprises:

a hollow lower seat, a hollow upper seat disposed on the hollow lower seat, and a block disk disposed between the hollow lower seat and the hollow upper seat, the hollow lower seat having a top flange and a top notch, a lower cushion surrounding the hollow lower seat and being blocked by the top flange, the upper seat having a bottom flange, a bottom notch, and a protrusion, an upper cushion surrounding the hollow upper seat and being blocked by the bottom flange, the block disk having an axle and an opposite block seat, the axle and the opposite block seat arranged along an axis on the block disk, a motor seat inserted in the top notch, the motor seat receiving a motor, the motor having a block inserted in the block seat, a controller disposed on the hollow lower seat, and wherein the controller controls a rotation of the motor and a vibration of the block disk.

2. A ventilator control device as claimed in claim 1, wherein the top flange has a recess receiving the axle and an insertion hole receiving the protrusion.

3. A ventilator control device as claimed in claim 1, wherein the controller has a heat/cool requirement unit, a comfortable rate adjustment unit, a stop requirement unit, at least a set element, at least a temperature sensor, at least a relative humidity sensor, a central processing unit, a swap analysis unit, a display unit, a steering control unit, a rotating speed control unit, and a time control unit.

4. A ventilator control device comprises:

a hollow lower seat, a hollow upper seat disposed on the hollow lower seat, a block disk disposed between the hollow lower seat and the hollow upper seat, the hollow lower seat having a top flange, a recess formed on the top flange, an insertion hole formed on the top flange, and a top notch, a lower cushion surrounding the hollow lower seat and being blocked by the top flange, the upper seat having a bottom flange, a bottom notch, and a protrusion, an upper cushion surrounding the hollow upper seat and being blocked by the bottom flange, the block disk having an axle and an opposite slot, a groove formed on a periphery of the block disk communicating with the slot, a positioning seat inserted in the top notch, the positioning seat having a through hole, a motor having a shaft and a block disposed on a distal end of the shaft, the motor inserted in the slot, the block inserted in the through hole, the recess receiving the axle, the insertion hole receiving the protrusion, a controller disposed on the hollow lower seat, and wherein the controller controls a rotation of the motor and a vibration of the block disk.

* * * * *